United States Patent [19]

Costan

[11] Patent Number: 4,782,666

[45] Date of Patent: Nov. 8, 1988

[54] REFRIGERATED CASE WITH VENTILATED GLAZED FRAME

[75] Inventor: Alberto Costan, Limana, Italy

[73] Assignee: Costan S.p.A., Limana, Italy

[21] Appl. No.: 96,882

[22] PCT Filed: Nov. 19, 1986

[86] PCT No.: PCT/IT86/00083

§ 371 Date: Aug. 11, 1987

§ 102(e) Date: Aug. 11, 1987

[87] PCT Pub. No.: WO87/03671

PCT Pub. Date: Jun. 18, 1987

[30] Foreign Application Priority Data

Dec. 11, 1985 [IT] Italy ..... 83444 A/85

[51] Int. Cl.[4] ..... A47F 3/04

[52] U.S. Cl. ..... 62/248; 62/507

[58] Field of Search ..... 62/248, 507

[56] References Cited

U.S. PATENT DOCUMENTS

| | | | |
|---|---|---|---|
| 2,462,705 | 2/1949 | Abeling | 62/248 |
| 2,542,136 | 2/1951 | Hanson | 62/248 |
| 2,672,735 | 3/1954 | Fusselman | 62/248 |
| 2,673,455 | 3/1954 | Brinkoeter | 62/248 |
| 2,696,087 | 12/1954 | Luecke | 62/248 |
| 2,911,799 | 11/1959 | Guyton | 62/248 |
| 3,462,966 | 8/1969 | Reid | 62/248 |
| 3,759,059 | 9/1973 | Kenyon | 62/246 |

FOREIGN PATENT DOCUMENTS

| | | |
|---|---|---|
| 1955051 | 10/1968 | Fed. Rep. of Germany . |
| 2307878 | 8/1974 | Fed. Rep. of Germany . |
| 2443228 | 4/1980 | France . |
| 2563423 | 10/1985 | France . |

*Primary Examiner*—Willaim E. Tapolcai

*Attorney, Agent, or Firm*—Wenderoth, Lind & Ponack

[57] ABSTRACT

A refrigerator display cabinet includes a refrigerated chamber having at least one transparent display window. A condenser and a compressor are positioned below the refrigerated chamber, and a fan draws exterior air through the condenser to thereby warm the air and then directs the warm air to the compressor. A deflector diverts a portion of the flow of warm air from the condenser to the compressor into a duct including a first duct portion extending horizontally from the deflector above the compressor. The dimension of the first duct portion in a direction transverse to the direction of air flow progressively decreases away from the deflector. The first duct portion opens laterally along one entire side thereof. A second duct portion is connected to and extends upwardly from the open side of the first duct and opens in a direction toward the outer surface of the display window. As a result, the diverted portion of the warm air passes horizontally through the first duct portion above the compressor and then passes upwardly through the second duct and is discharged therefrom across the outer surface of the display window, thereby preventing the formation of condensation on the display window.

3 Claims, 2 Drawing Sheets

REFRIGERATED CASE WITH VENTILATED GLAZED FRAME

BACKGROUND OF THE INVENTION

The present invention relates to a refrigerator display case or cabinet with a ventilated glazed frame or surface and having a refrigerated chamber with a condenser and compressor positioned therebelow. The present invention finds particular and convenient, through not exclusive, application to refrigerator display cabinets for foodstuffs.

In the present state of the art, it is well-known that refrigerator display cabinets, having display windows that are internally cooled, tend to generate condensate on the corresponding external window surfaces, thus fogging the windows which thereby no longer are suitably transparent for display of contents within the refrigerated chamber. This is disadvantageous in display environments, such as shops or supermarkets, since the products inside the chamber are not clearly visible through the windows, consequently adversely effecting sales.

Many attempts to solve this problem have been made:

1. Through the use of an electrically operated heating element having a resistor, in most cases metallic, and placed in direct contact with the respective plate glass.
2. Through the use of "radiant glasses", i.e. electrically heated, through the insertion of electrical filaments into the plate glass.
3. Through external ventilation of the glazed surface by means of an air stream at ambient temperature sweeping across the external glazed surface.

The first two solutions are very extensive because they require high operating costs (electrical energy expenditure, resistors wearing out, etc.). The third solution, although obviating the higher operating costs for energy expenditure, results in an expenditure of energy by a supplemental fan and in the cost of the respective system. Furthermore, the anti-fogging effect is not very effective since the ventilated air also results in a condensate effect, though less than in a system totally without ventilation.

SUMMARY OF THE INVENTION

The object of the present invention is to provide an arrangement whereby it is possible to remedy the above and other prior art drawbacks.

This object is achieved according to the present invention by the use of an external ventilation system for preventing fogging of the glazed surfaces, by means of a warm air flow from the condenser. Specifically, a baffle positioned above and between the condenser and compressor diverts a portion only of the air flow from the condenser into a flattened duct extending above the compressor, the remaining air flow passing to the compressor in a conventional manner.

The advantage obtained by this invention is that the amount of electrical energy required to heat the air is reduced. In a preferred embodiment, a ventilation system includes a fan positioned immediately upstream of the baffle.

By means of this invention, it is possible to use the structure necessary to cool the condenser also as a ventilation system for preventing fogging. In a further feature of this invention, the ventilation system is designed to draw ambient air through the condenser and convey such air to the ventilation system while removing heat from the compressor apparatus located therebelow and thereby also insulating the refrigerator chamber from the heat emitted by the compressor. Thus, the system draws warm air from the condenser and passes it through a laminar duct positioned under the bottom of the refrigerator or chamber.

By this invention it is possible to reduce the overall dimensions of the assembly. Moreover, the arrangement of the structural elements is realized in an economical way, allowing the laminar flow of warm air to be conveyed laterally from the bottom and then as a continuous ascending veil externally wiping or passing across the exterior of the transparent surface, thus preventing condensation thereon.

BRIEF DESCRIPTION OF THE DRAWINGS

One way of carrying out this invention is described in detail below, with reference to the drawings, which illustrate only one specific embodiment, and in which.

DETAILED DESCRIPTION OF THE INVENTION

Figure 1:
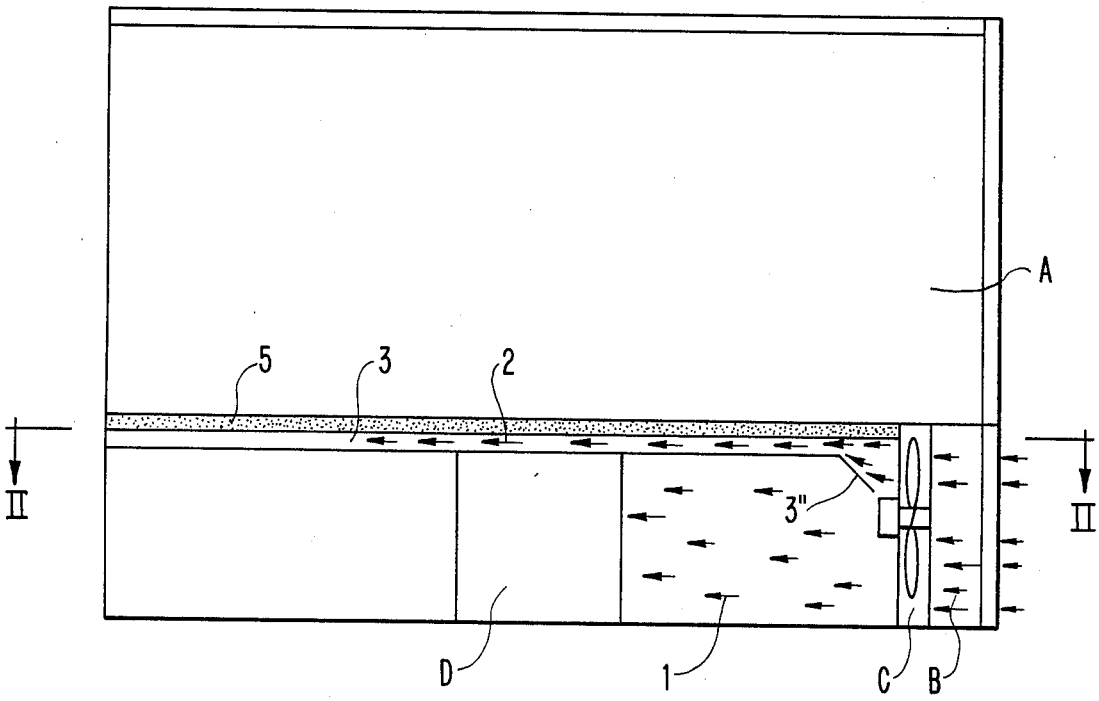
FIG. 1 is a schematic vertical front section, taken along line I—I in FIG. 3, of a refrigerated case in accordance with a preferred embodiment of the invention.
Figure 2:
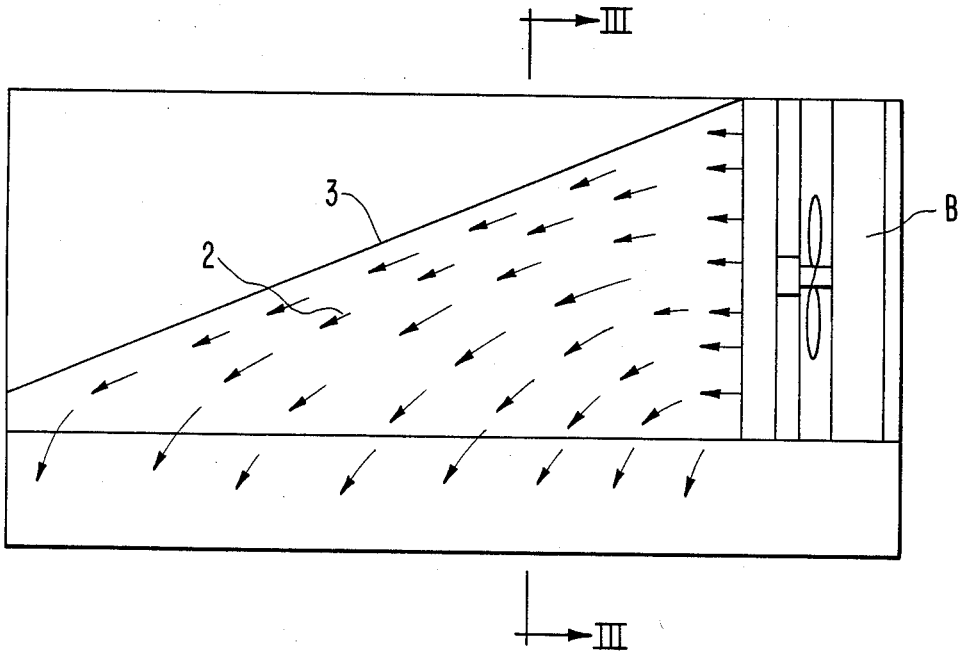
FIG. 2 is a horizontal section taken along line II—II of FIG. 1.
Figure 3:
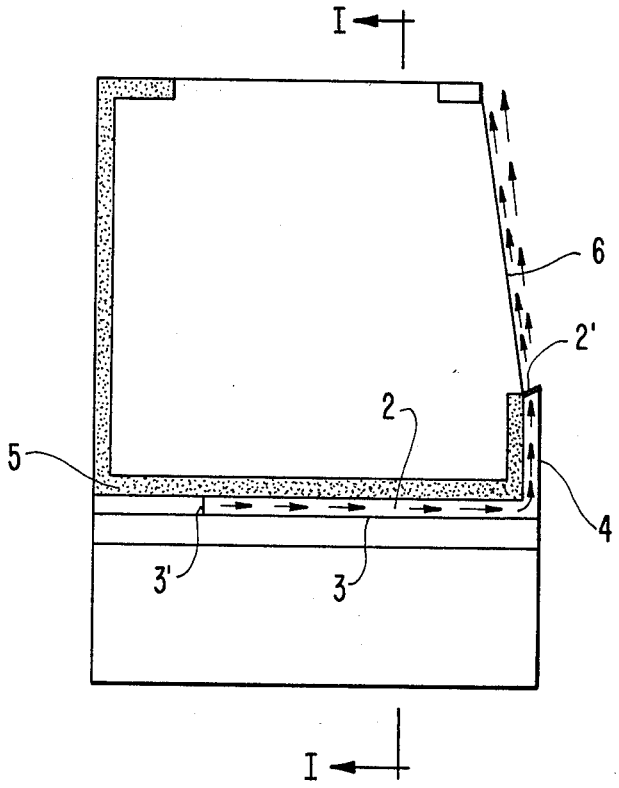
FIG. 3 is a transversal side section taken along line III—III of FIG. 2.
Figure 4:
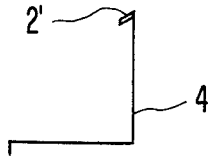
FIG. 4 is a schematic section showing the shape of a covering front member employed for the conveyance of air across a front glazed surface.

As shown in the drawings, the invention concerns a refrigerator display cabinet or case having at least one refrigeration chamber A defined by at least one glazed, e.g. glass or other transparent material, display surface 6 that extends approximately vertical or more or less inclined to the vertical. Under bottom 5 of chamber A are provided a condenser B and a compressor D having therebetween, sheltered by the condenser, ventilation means C for drawing in fresh air from the exterior, passing it through condenser B and directing it to cool compressor D. Under bottom 5 of the chamber A is positioned a flattened or laminar air duct 2 defined by a double bottom 3 having a transverse section 3' that becomes progressively smaller in the direction of air flow and that opens frontally into a vertical channel 4 with an elongated laminar opening 2' through which the air is discharged across the entire width of surface 6. The air passes through a baffle mouth 3'' into duct 2. Baffle mouth 3'' transfers to duct 2 at least a portion of the air conveyed by ventilation means C.

This system is thus very simple and makes it possible to utilize the same operating means, both for obtaining refrigeration and for obtaining warm air ventilation, without any further energy expenditure, to maintain the glazed surfaces of the refrigerator cabinet always unfogged.

As is well known, the ventilation means C, e.g. a fan, may be reversed to thus convey the air in the reverse direction, in order to clean from time to time the grid of the condenser. However, this will not affect the actual anti-fogging efficacy of the system, since the periods of such operation are short and occasional. Of course, in a preferred solution, deflecting baffle 3'' is adjustable in order to vary the quantity of the anti-fogging warm air flow.

I claim:

1. In a refrigerator display cabinet including a refrigerated chamber having at least one transparent display window, a cooling system for cooling said refrigerated chamber and including a condenser and a compressor positioned below said refrigerated chamber and means for drawing exterior air through said condenser to thereby warm said air and then directing said warm air to said compressor, and means for preventing condensation from forming on said display window, the improvement wherein said condensation preventing means comprises:

deflector means for diverting a portion only of the flow of warm air from said condenser to said compressor;

duct means for receiving and conveying the diverted portion of said warm air and for discharging said diverted portion in a direction to pass across the outer surface of said display window;

said duct means comprising a first duct extending horizontally from said deflector means above said compressor, the horizontal dimension of said first duct, in a direction transverse to the direction of air flow from said condenser to said compressor, progressively decreasing in a direction away from said deflector means, and said first duct opening laterally along one entire side thereof extending transverse to said horizontal dimension; and said duct means further comprising a second duct connected to and extending upwardly from said side of said first duct and opening in a direction toward said outer surface of said display window;

whereby said diverted portion of said warm air passes horizontally through said first duct above said compressor and then passes upwardly through said second duct and is discharged therefrom across said outer surface of said display window.

2. The improvement claimed in claim 1, wherein said drawing means comprises a fan positioned immediately upstream of said deflector means.

3. The improvement claimed in claim 1, wherein said drawing means comprises a fan capable of reverse operation.

* * * * *